US009662554B2

(12) United States Patent
Skurow et al.

(10) Patent No.: US 9,662,554 B2
(45) Date of Patent: May 30, 2017

(54) GOLF BALL EJECTION DEVICE

(71) Applicants: David Skurow, Orlando, FL (US); Allen Skurow, Orlando, FL (US)

(72) Inventors: David Skurow, Orlando, FL (US); Allen Skurow, Orlando, FL (US)

( * ) Notice: Subject to any disclaimer, the term of this patent is extended or adjusted under 35 U.S.C. 154(b) by 0 days.

(21) Appl. No.: 15/212,865

(22) Filed: Jul. 18, 2016

(65) Prior Publication Data

US 2017/0014694 A1 Jan. 19, 2017

Related U.S. Application Data

(63) Continuation-in-part of application No. 14/733,033, filed on Jun. 8, 2015, now Pat. No. 9,415,283.

(60) Provisional application No. 62/009,637, filed on Jun. 9, 2014.

(51) Int. Cl.
*A63B 57/40* (2015.01)
*A63B 57/00* (2015.01)

(52) U.S. Cl.
CPC ..... *A63B 57/405* (2015.10); *A63B 2225/50* (2013.01)

(58) Field of Classification Search
CPC ..... A63B 57/405; A63B 57/357; A63B 57/40; A63B 69/3676; A63B 2063/001; A63B 2225/50
USPC ..... 473/178, 177, 163, 182, 183, 191, 194
See application file for complete search history.

(56) References Cited

U.S. PATENT DOCUMENTS

| | | | | |
|---|---|---|---|---|
| 3,310,312 | A | 3/1967 | Peeples | |
| 3,467,378 | A | 9/1969 | English | |
| 3,897,059 | A | 7/1975 | McCulloch et al. | |
| 5,018,730 | A | 5/1991 | Iliuta | |
| 5,174,574 | A | 12/1992 | Knox et al. | |
| 5,382,018 | A | 1/1995 | Browne | |
| 5,480,142 | A | 1/1996 | Ackerman | |
| 5,890,967 | A | 4/1999 | Allen | |
| 8,025,584 | B2 | 9/2011 | Foley | |
| 9,415,283 | B2 * | 8/2016 | Skurow | A63B 57/0056 |

* cited by examiner

*Primary Examiner* — Mark Graham
(74) *Attorney, Agent, or Firm* — Jason T. Daniel, Esq.; Daniel Law Offices, P.A.

(57) ABSTRACT

A golf ball ejection device includes a generally cylindrical cup liner having an open top end, and a curved bottom end with an elongated hollow channel extending downward therefrom. A golf ball ejector is positioned at the bottom end of the channel and is in communication with a controller and a power source. A golf ball sensor and controller timer detect the presence of a golf ball and activate the golf ball ejector upon the completion of a predetermined countdown.

14 Claims, 5 Drawing Sheets

GOLF BALL EJECTION DEVICE

CROSS-REFERENCE TO RELATED APPLICATIONS

This application claims the benefit of U.S. Application Ser. No. 62/009,637 filed on 9 Jun. 2014, and is a continuation-in-part to U.S. application Ser. No. 14/733,033 filed on 8 Jun. 2015, the contents of each of which are incorporated herein by reference.

TECHNICAL FIELD

The present invention relates generally to the game of golf, and more particularly to a device for ejecting a golf ball from a hole on a golf course green.

BACKGROUND

The statements in this section merely provide background information related to the present disclosure and may not constitute prior art.

In recent years, the game of golf has seen a dramatic increase in popularity and continues to attract scores of new players each day. To meet this demand, manufactures are constantly working on improvements for items such as golf balls, golf clubs, golf bags, golf shoes and other such articles which are used during game play. However, one portion of the game which has received extremely limited attention involves the process of retrieving the golf ball from the hole located on the green.

There are several known golf ball retrieval devices which can aid a golfer in retrieving the ball from the hole. The most common of these devices is typically secured onto the end of a putter, and allows the user to retrieve the ball without having to bend. Although useful in some regard, many golfers dislike these devices as their presence on the golf club can be a distraction during play, and because the weight of the device can alter the natural putting motion of the golfer.

Accordingly, it would be beneficial to provide a device for ejecting a golf ball from a golf course hole that does not suffer from the drawbacks of the above noted devices.

SUMMARY OF THE INVENTION

The present invention is directed to a golf ball ejection device for use on a golf course green. One embodiment of the present invention can include a generally cylindrical cup liner having an open top end and a curved bottom surface. An elongated channel extends downward from the curved bottom surface, and a golf ball ejector, power source and controller are located beneath the cup liner. The golf ball ejector includes an elongated rod having a distal tip which traverses the elongated channel. The elongated channel also functions to receive and position a golf flag pole.

Another embodiment of the present invention can include one or more golf ball sensors that are positioned within the cup liner and/or the elongated channel. The golf ball sensor(s) can function to detect the presence of a golf ball and report the same to the controller. The controller can further include a timer module. The timer module can function to initiate a user-selectable countdown upon receiving the detection notification, and the golf ball ejector can eject the detected golf ball upon completion of the countdown process.

In yet another embodiment, the elongated channel can further include a flag pole sensor which can function to prevent operation of the golf ball ejector upon detecting the presence of a flagpole within the channel.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
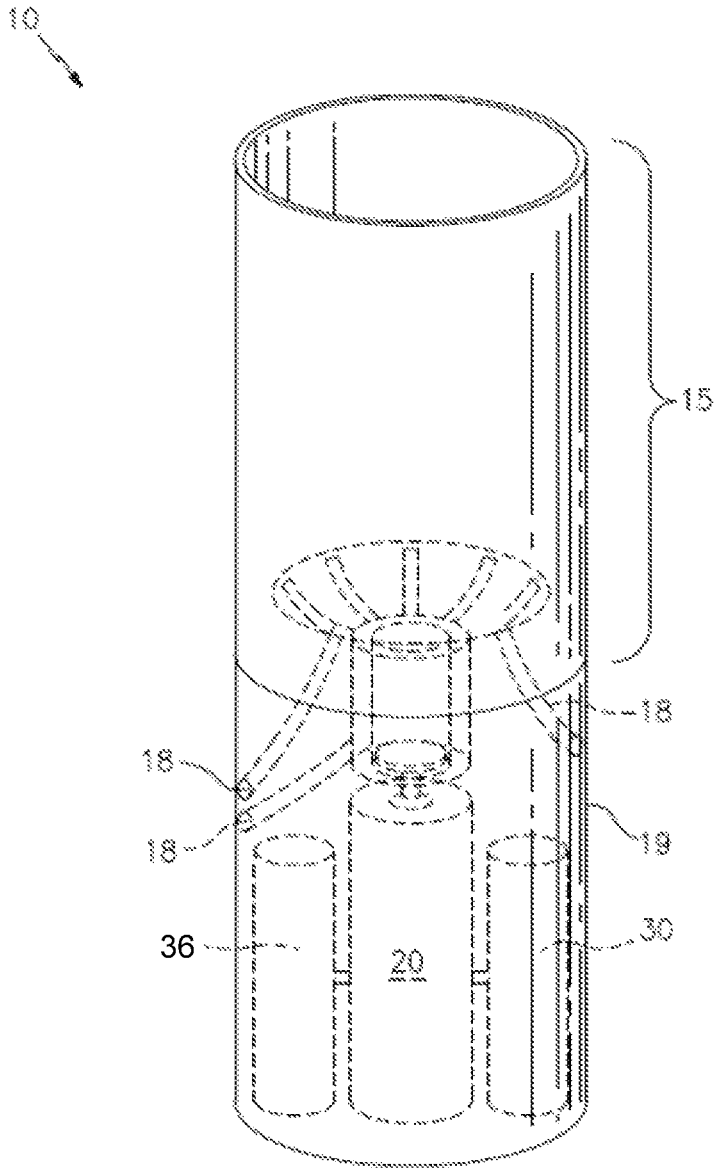
FIG. 1 is a perspective view of a golf ball ejection device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

The present disclosure contemplates a device for ejecting a golf ball from a golf course hole. As will be described below in detail, the device can be constructed from any number of different materials and can be used for many different purposes. In this regard, the below descriptions and illustrations are to provide but one means for performing the inventive concepts and are not to be construed as limiting in any way.

Figure 2:
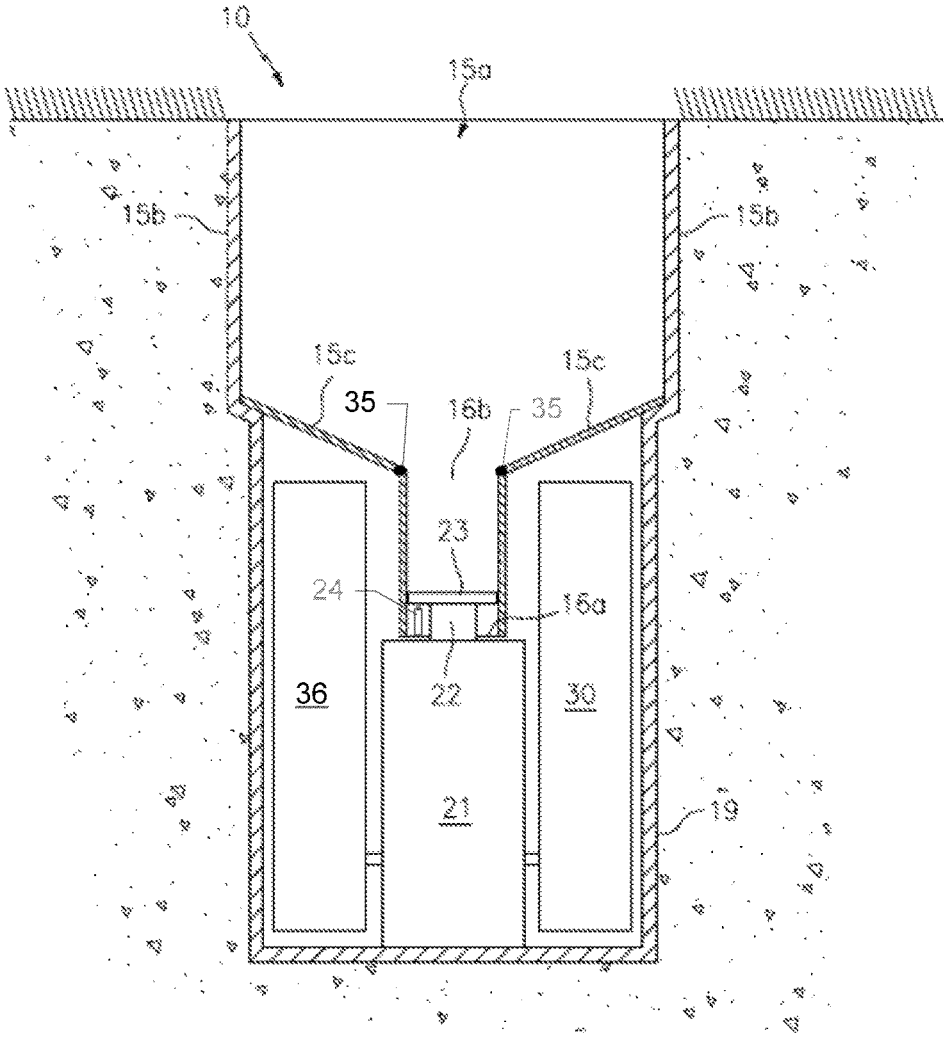
FIG. 2 is a partial cutout side view of the golf ball ejection device, in accordance with one embodiment of the invention.
Figure 3:
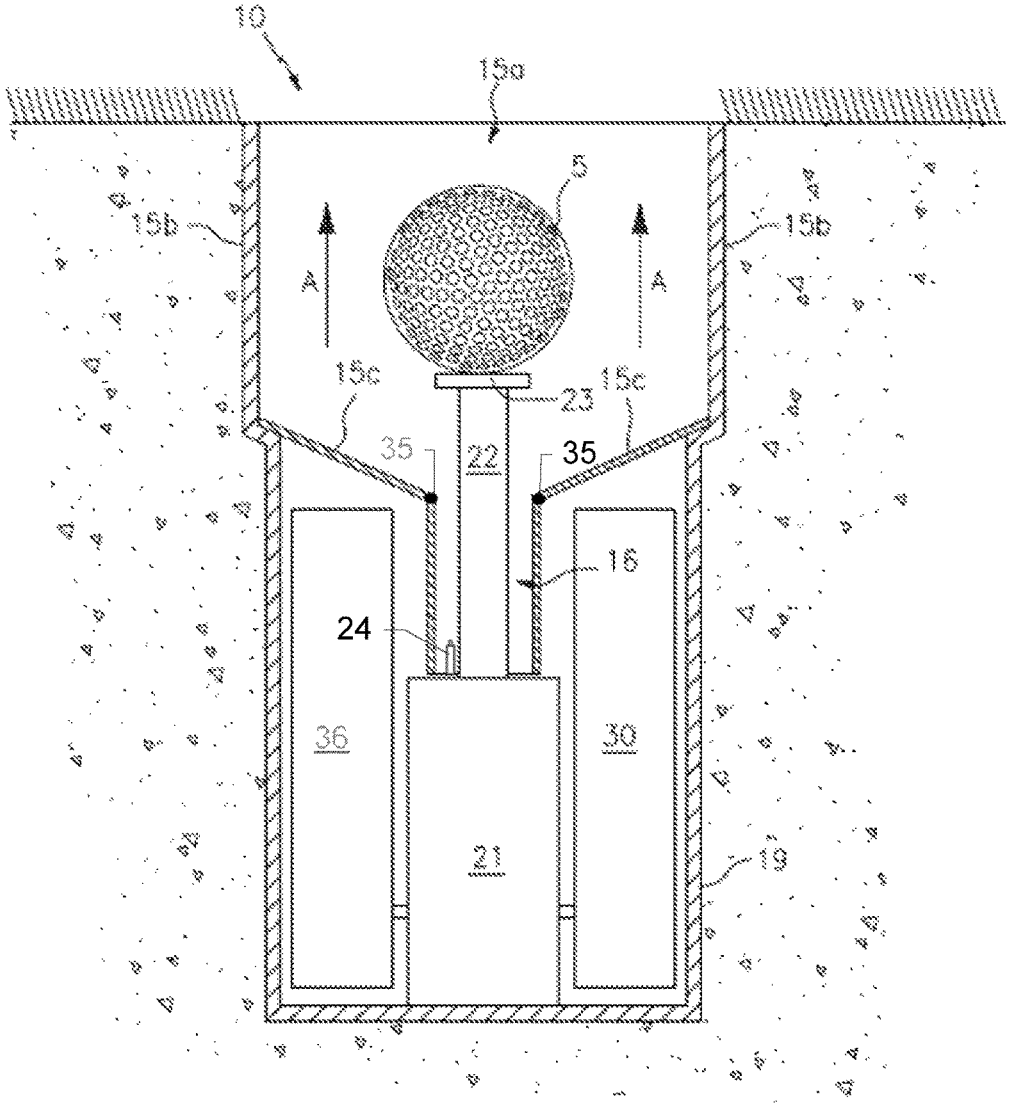
FIG. 3 is another partial cutout side view of the golf ball ejection device, in accordance with one embodiment of the invention.

FIGS. 1-3 illustrate one embodiment of a golf ball ejection device 10 that is useful for understanding the inventive concepts disclosed herein. As shown, the device can include, essentially, a hole liner 15, a golf ball ejector 20, a controller 30 and a power source 36. Although the device will be described and illustrated with particular components at specific locations, this is for illustrative purposes only, as each of the below described components can include any number of different shapes, sizes, dimensions and orientation to each other.

The hole liner 15 can be positioned along the top of the device, and can function to receive a golf ball and a hole identification flag pole. In the preferred embodiment, the hole liner 15 can include an elongated, generally cylindrical member having an open top end 15*a*, a generally circular middle section 15*b* and an angled bottom section 15*c* terminating into an elongated generally hollow channel 16. In one embodiment, a series of apertures 18 can be disposed along the hole liner in order to prevent moisture such as rainwater from accumulating therein. As shown, each of the apertures can form a channel for directing water into the surrounding ground. In the preferred embodiment, the hole liner 15 can be constructed from a sturdy material such as hard plastic, for example; however, any number of other materials that are suitable for prolonged exposure to the elements are also contemplated.

Although dimensions are not critical, the hole liner 15 can preferably include an inside diameter of approximately 4.25 inches, and a depth (measured from the top end 15*a* to the bottom end 15*b*) of between approximately 4.5 and 6 inches, for example. Such dimensions being in conformity with the United States Golf Association (USGA) regulations for a standard sized golf course hole liner. Likewise, the hollow channel 16 can preferably include a diameter of between approximately ¼ and ¾ inches, so as to receive a standard golf course flag pole, and to position the same upright. Of course, any number of other shapes, and sizes are also contemplated, so as to facilitate use in other sports and/or to accommodate rule changes in golf.

The device 10 can also include a lower body housing 19, which can function to house each of the ejector 20, the controller 30, and the power source 36. In this regard, the lower body can preferably be constructed from a rigid, waterproof material such as hardened plastic, for example. The lower body can be constructed as an integral component with the hole liner 15, or can be positioned as one or more separate components that are mated together and/or with the bottom end of the hole liner 15, in accordance with known construction methodologies.

In either instance, the lower body 19 can also preferably include a generally cylindrical shape so as to allow the entire device 10 to be positioned within a standard sized 4.25 inch hole created on a golf course green via an auger, or other such device. Of course, any number of other shapes and sizes are also contemplated.

The golf ball ejector 20 can function to eject a golf ball 5 from the liner 15 at a controlled velocity. As shown in best FIGS. 2 and 3, wherein a portion of the liner 15 and outer body 19 are removed for ease of illustration, the golf ball ejector can include an electrically powered linear actuator 21, having an internal motor that moves an elongated piston rod 22. In one embodiment, the piston rod 22 can include a broad tip 23 that can be located within the channel 16. In either instance, the piston rod 22 can transition between the retracted state shown in FIG. 2, and the extended state shown in FIG. 3 when the ejector 20 receives a command from the controller 30.

When in the retracted state, the majority of the piston rod 22 can be located within the linear actuator body so as to position the tip 23 against or adjacent to the lower end of the channel 16*a*. When so positioned, the channel 16 can function in a traditional manner to receive and support a flag pole 2 therefrom. In one embodiment, the ejector 20 can include a flag sensor 24 which can detect the weight of the flag pole 2 against the tip of the rod 23. Such a sensor can function as a kill switch to prevent operation of the ejector 20 when a flag is present. Of course, any number of other devices capable of detecting the presence of the flag pole 2 and preventing operation of the ejector 20 are also contemplated.

Figure 5:
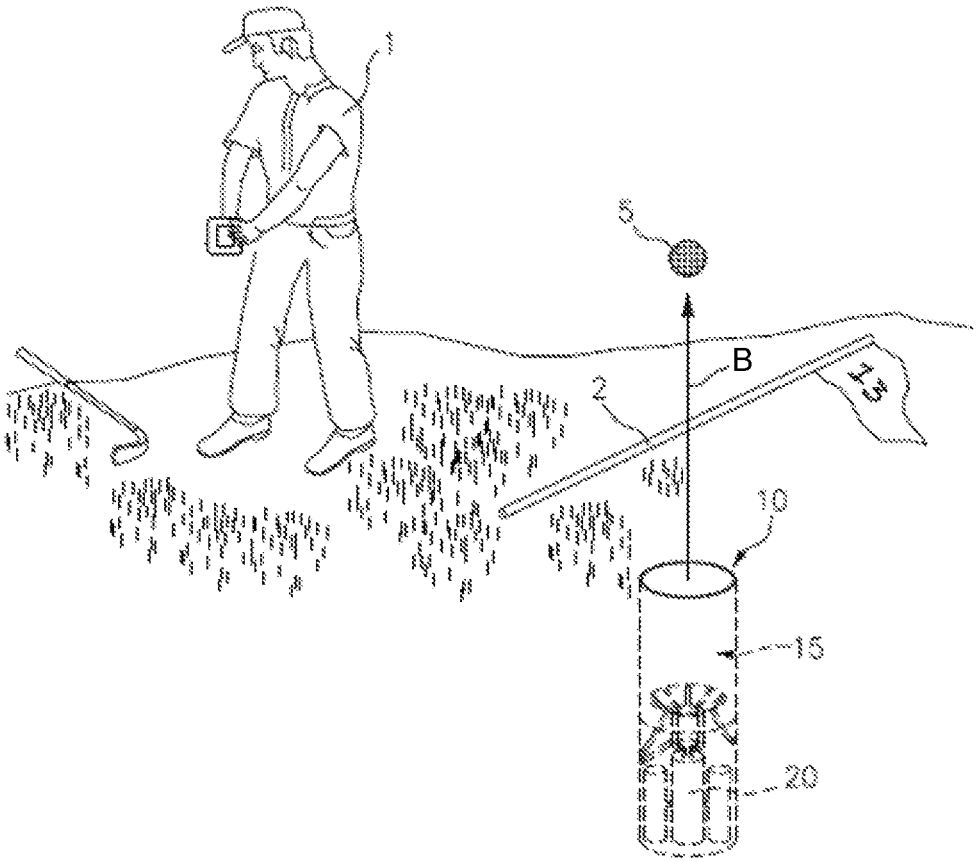
FIG. 5 is a perspective view of the golf ball ejection device in operation, and in accordance with one embodiment of the invention.

Conversely, when no flag pole is positioned within the channel 16, and upon being activated by the below described controller 30, the actuator 21 can rapidly extend the rod 22 and tip 23 towards/through the upper end of the channel 16*b*, so as to engage and propel a golf ball 5 located at the bottom of the hole liner 15 upwards and out of the hole liner (see arrow A). Owing to the curved bottom end of the liner 15, any golf ball 5 located within the liner will be gravity fed to the center of the liner so as to rest directly above the upper end of the channel 16*b*. As shown in FIG. 5, the ejector 20 can eject the ball 5 vertically to any desirable height A, so as to allow a user 1 to easily catch the discharged golf ball in the air.

Although the speed and velocity of the actuator movement is not critical, in one preferred embodiment, the actuator can move the rod 22 and/or tip 23 upwards at a speed of between approximately 5 and 12 miles per hour, so as to impart a force that is sufficient to gently propel the golf ball upwards to a height of between approximately 3 and 5 feet from the top of the liner. Of course, any number of other speeds and/or forces are also contemplated so as to allow a golf ball to be ejected to a height that is greater or less than that described above. In some instances, the speed and/or force can be adjusted by a user (such as a golf course staff, for example) so as to adjust for environmental factors such as altitude and humidity, for example.

Although described above as utilizing an electrically powered linear actuator, this is but one possible means for engaging the golf ball and ejecting the same from the hole. As such, the invention is not to be construed as limiting in this regard, as the golf ball ejector 20 can include any number of other known devices capable of launching a golf ball vertically from the liner to a predetermined height.

Figure 4:
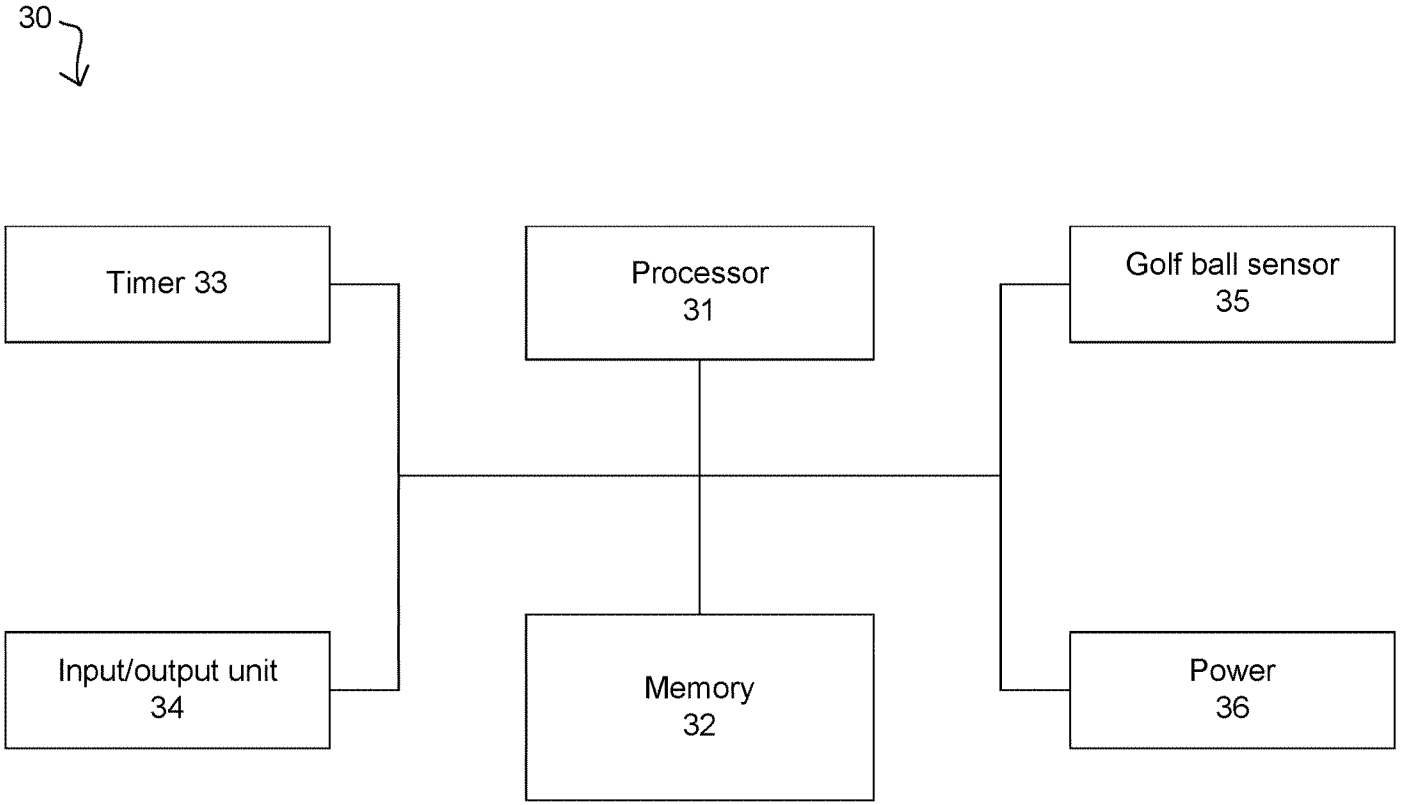
FIG. 4 is a simplified block diagram of the controller, in accordance with one embodiment of the invention.

FIG. 4 is a simplistic block diagram illustrating one embodiment of a controller 30 for use within the device 10. In one embodiment, the controller 30 can include a processor 31 that is conventionally connected to an internal memory 32, a timer module 33, an input/output unit 34, one or more ball sensors 35, and the power source 36.

Although illustrated as separate elements, those of skill in the art will recognize that one or more system components 30 may be, or include one or more printed circuit boards (PCB) containing an integrated circuit or circuits for completing the activities described herein. The CPU may be one or more integrated circuits having firmware for causing the circuitry to complete the activities described herein. Moreover, other embodiments are contemplated wherein one or more of the above components are omitted.

The processor/CPU 31 can act to execute program code stored in the memory 32 in order to allow the device to perform the functionality described herein. Likewise, a timer module 33 can be provided, and can function to accurately measure the passage of time. As described herein, the timer module can be provided as a function of the processor or can include a separate physical circuit. In either instance, processors and timers are extremely well known in the art, therefore no further description will be provided.

Memory 32 can act to store operating instructions in the form of program code for the processor 31 to execute. Although illustrated in FIG. 4 as a single component, memory 32 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 32 can also include one or more cache memories that provide temporary storage of at least some program code in order to reduce the number of times program code must be retrieved from the bulk storage device during execution. Each of these devices is well known in the art.

The input/output unit 34 can function to accept user inputs, provide information to a user, and/or to provide instructions to the processor. In various embodiments, the input/output unit can include or control one or more buttons/switches that are connected to the processor 31 so as to activate various programmatic functions, such as adjusting the strength of the ejector 20, for example, and/or specifying a countdown period for the timer before ejecting the golf ball. In addition to above, the input/output unit can further include or control any number of lights so as to provide a user with a battery level indicator and/or an ON or OFF operating state, for example. Moreover, the input/output unit can include or control one or more communication ports such as a Universal Serial Bus or micro USB, for example, in order to send and receive information with another device via a direct communication link.

One or more ball sensors 35 can be provided with the device in order to detect the presence of a golf ball located within the liner 15. In the preferred embodiment, the sensor 35 can include a commercially available photoelectric sensor, and more preferably a diffused proximity sensor that is located along or within the cup liner 15 and/or the channel 16. Photoelectric sensors are well known in the art, and function to generate an electric signal upon detecting the presence or absence of an object located within the sensor range. Of course, any number of other types of sensors can be provided in conjunction with, or in place of the above described photoelectric sensor.

The power source can preferably include or comprise one or more batteries 36 which can function to supply the necessary power requirements to the ball ejector 20 and/or the controller 30. The batteries can preferably be located within the lower body 19, and can be accessible via a battery compartment (not illustrated) or through a charging port such as a mini or micro USB port, for example. Of course, the device can also include any number of externally located batteries, and/or can be configured to operate utilizing AC power, in the event that underground electric facilities are available. Of course, the device may also be solar powered through the use of any number of solar cells (not shown).

FIG. 5 illustrates one embodiment of the device 10 in operation, wherein upon receiving a signal from the flag sensor 24 that the flag pole 2 has been removed, and/or upon removal of the flag, the processor 31 can activate the ball sensor(s) 35 which can send a notification signal to the processor when a golf ball 5 drops into the hole liner 15. Upon receiving the notification signal, the timer module 33 can begin a predetermined countdown such as 10, 20 or 30 seconds, for example. When the countdown reaches zero, the processor can activate the ball ejector 20 which can move to the extended state, thereby propelling the golf ball 5 upwards (see arrow B) out of the hole liner 15 where it can be easily caught by the golfer 1.

Accordingly, the above described golf ball ejection device 10 can function to automatically discharge a golf ball from a hole liner on a golf course green, thereby preventing a user from having to bend over to retrieve the ball from within the hole.

As described herein, one or more elements of the golf ball ejection device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the cup liner 15 and the lower body 19, for example, may be formed together as one or more different and/or continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A golf ball ejection device for use on a golf course green, said device comprising:

a generally cylindrical cup liner having an open top end, and a bottom end;

an elongated hollow channel having an upper end that is positioned along a center of the bottom end of the cylindrical cup liner, said hollow channel including a shape and dimension that is suitable for receiving and positioning a golf flag pole in a vertical orientation;

a golf ball sensor that is in communication with the cup liner, said sensor being configured to detect a presence of a golf ball within the cup liner;

a golf ball ejector that is in communication with the elongated hollow channel, said ejector functioning to eject the detected golf ball vertically to a first height;

a controller that is in communication with each of the golf ball sensor and the golf ball ejector, said controller functioning to automatically activate the golf ball ejector upon receiving a detection notification from the golf ball sensor; and a power source that is in communication with each of the controller and the golf ball ejector.

2. The device of claim 1, wherein the controller includes:

a timer module that is configured to begin a predetermined countdown upon receiving the detection notification from the golf ball sensor, and wherein the golf ball ejector is configured to eject the detected golf ball upon the expiration of the countdown.

3. The device of claim 2, wherein the controller further includes:

an input/output unit that is configured to receive a user command.

4. The device of claim 3, wherein the predetermined countdown is adjustable via the input/output unit.

5. The device of claim 1, further comprising:

a flag pole sensor that is in communication with the elongated hollow channel, said flag pole sensor being configured to detect the presence of a flag pole within the hollow channel, and to prevent operation of the golf ball ejector.

6. The device of claim 1, wherein the golf ball ejector comprises:

a linear actuator having a telescoping rod and a tip member along a distal end.

7. The device of claim 6, wherein the rod and tip member include a shape and size that is suitable for moving within the elongated hollow channel.

8. The device of claim 7, wherein the rod and tip member are located adjacent to a bottom end of the elongated hollow channel when the device is in a retracted state.

9. The device of claim 7, wherein the rod and tip member are located adjacent to a top end of the elongated hollow channel when the device is in an extended state.

10. The device of claim 1, further comprising:

a plurality of apertures that are disposed along the cylindrical cup liner, said apertures functioning to remove water from an inside surface of the cylindrical cup liner.

11. The device of claim 1, further comprising:

a plurality of apertures that are disposed along the elongated hollow channel, said apertures functioning to remove water from an inside surface of the channel.

12. The device of claim 1, wherein the cylindrical cup liner includes an inside diameter of approximately 4.25 inches.

13. The device of claim 1, further comprising:

a waterproof lower body that is in communication with the cylindrical cup liner, and including a generally hollow portion for positioning each of the golf ball ejector, the controller and the power source.

14. The device of claim 1, wherein the first height is between approximately 3 and 5 feet from the open top end of the cup liner.

* * * * *